US009427771B2

(12) United States Patent
Asami et al.

(10) Patent No.: US 9,427,771 B2
(45) Date of Patent: Aug. 30, 2016

(54) METHOD FOR FORMING COATING ON SCROLL TYPE FLUID MACHINE

(71) Applicant: ANEST IWATA CORPORATION, Yokohama-shi, Kanagawa (JP)

(72) Inventors: Junichi Asami, Yokohama (JP); Tatsuya Minegishi, Yokohama (JP); Tohru Kuwata, Yokohama (JP)

(73) Assignee: ANEST IWATA CORPORATION, Kanagawa (JP)

( * ) Notice: Subject to any disclaimer, the term of this patent is extended or adjusted under 35 U.S.C. 154(b) by 297 days.

(21) Appl. No.: 13/940,528

(22) Filed: Jul. 12, 2013

(65) Prior Publication Data

US 2013/0302518 A1 Nov. 14, 2013

Related U.S. Application Data

(63) Continuation of application No. PCT/JP2011/077752, filed on Dec. 1, 2011.

(30) Foreign Application Priority Data

Jan. 14, 2011 (JP) ..... 2011-006385

(51) Int. Cl.
*B05D 1/02* (2006.01)
*F01C 1/02* (2006.01)
(Continued)

(52) U.S. Cl.
CPC ..... *B05D 1/02* (2013.01); *B05D 1/002* (2013.01); *F01C 1/0269* (2013.01); *F04C 18/0269* (2013.01); *F04C 2230/91* (2013.01); *F05B 2230/90* (2013.01)

(58) Field of Classification Search
None
See application file for complete search history.

(56) References Cited

U.S. PATENT DOCUMENTS 4,802,831 A * 2/1989 Suefuji ..... B29C 5/14 418/152
5,258,046 A * 11/1993 Haga ..... F01C 1/0223 418/142
5,468,130 A * 11/1995 Yamada ..... F01C 17/06 418/178

(Continued)

FOREIGN PATENT DOCUMENTS

BE 1010426 A3 7/1998
EP 1454678 A1 9/2004

(Continued)

OTHER PUBLICATIONS

International Search Report corresponding to PCT/JP2011/077752, dated Feb. 7, 2012.

(Continued)

*Primary Examiner* — William Philip Fletcher, III
(74) *Attorney, Agent, or Firm* — Hauptman Ham, LLP

(57) ABSTRACT

An orbiting scroll is fixed on a rotating table and rotated about a spiral center. A spray nozzle is positioned in the spiral center or at an outside end of the orbiting scroll and caused to discharge a coating toward a side face of a wrap portion. The spray nozzle is moved along a straight line in a radial direction while discharging the coating. When a spraying start position is set as the spiral center, a rotation angle speed of the orbiting scroll is gradually reduced in accordance with the movement of the spray nozzle. When the spraying start point is set as the outside end, the rotation angle speed of the orbiting scroll is gradually increased in accordance with the movement of the spray nozzle. As a result, the coating can be applied to the wrap portion side face evenly.

5 Claims, 2 Drawing Sheets

(51) Int. Cl.
*F04C 18/02* (2006.01)
*B05D 1/00* (2006.01)

(56) References Cited

U.S. PATENT DOCUMENTS

| | | | | |
|---|---|---|---|---|
| 6,224,357 | B1 | 5/2001 | Komai et al. | |
| 6,371,667 | B1 * | 4/2002 | Kitano | G03D 5/00 118/52 |
| 6,783,338 | B2 * | 8/2004 | Moroi | F04C 18/0284 418/178 |
| 7,331,274 | B2 | 2/2008 | Sugiura et al. | |
| 7,785,088 | B2 * | 8/2010 | Taniguchi | F04C 18/0215 418/178 |
| 2003/0091746 | A1 * | 5/2003 | Takahashi | B05D 3/0254 427/385.5 |
| 2008/0159894 | A1 * | 7/2008 | Kanemoto | F01C 1/0215 418/55.2 |
| 2011/0262636 | A1 | 10/2011 | Ohta et al. | |

FOREIGN PATENT DOCUMENTS

| | | | | |
|---|---|---|---|---|
| EP | 2199844 | A1 | | 6/2010 |
| JP | 64-69788 | A | | 3/1989 |
| JP | 2-145687 | U | | 12/1990 |
| JP | 8189482 | A | | 7/1996 |
| JP | H08-189482 | A | * | 7/1996 |
| JP | 9-88851 | A | | 3/1997 |
| JP | 11280669 | A | | 10/1999 |
| JP | 2000350955 | A | | 12/2000 |
| JP | 2003035284 | A | | 2/2003 |
| JP | 2003211084 | A | | 7/2003 |
| JP | 2006-336674 | A | | 12/2006 |
| JP | 2008-163845 | A | | 7/2008 |
| JP | 2009057897 | A | | 3/2009 |
| WO | 2009025272 | A1 | | 2/2009 |
| WO | WO 2009/025272 | A1 | * | 2/2009 |

OTHER PUBLICATIONS

Corresponding International Application No. PCT/JP2011/077752 English Translation of Written Opinion and Search Report dated Jul. 16, 2013.

Office Action mailed Jun. 10, 2011, corresponding to Japanese Patent Application No. 2011-006386.

Extended European Search Report dated Jul. 24, 2014, corresponding to European Patent Application No. 11855481.5.

International Preliminary Report on Patentability mailed Jul. 25, 2013, corresponding to International Patent Application No. PCT/JP2011/077753.

Office Action mailed Jul. 17, 2015, corresponding to U.S. Appl. No. 13/940,660.

Office Action mailed Dec. 10, 2015, corresponding to U.S. Appl. No. 13/940,660.

* cited by examiner

METHOD FOR FORMING COATING ON SCROLL TYPE FLUID MACHINE

RELATED APPLICATIONS

The present application is a continuation of International Application Number PCT/JP2011/077752, filed Dec. 1, 2011, and claims priority from Japanese Application Number 2011-006385, filed Jan. 14, 2011. The above listed applications are hereby incorporated by reference in their entirety.

TECHNICAL FIELD

The present invention relates to a method and a device for forming an even coating on a side face of a spiral wrap portion of a scroll type fluid machine.

BACKGROUND ART

A scroll type fluid machine is used as a scroll type compressor, a scroll type vacuum pump, a scroll type expander, a scroll type air blower, and the like. A scroll type fluid machine is constituted by a fixed scroll and an orbiting scroll having spiral wrap portions that stand upright on endplates thereof, and a driving mechanism that causes the orbiting scroll to orbit without rotating. A plurality of enclosed spaces surrounded by the end plates and the wraps of the fixed scroll and the orbiting scroll are formed, and a processing subject gas is introduced into the enclosed spaces and subjected to processing such as compression, expansion, or decompression.

To secure a compression performance, a decompression performance, or the like in a scroll type fluid machine, the enclosed spaces formed by the fixed scroll and the orbiting scroll must be sealed tightly so that compression and decompression can be performed on the gas suctioned therein. Further, to suppress galling, wear, damage, and the like between the wrap portions of the fixed scroll and the orbiting scroll, a minute gap of a size at the micron scale must be formed between the wrap portion of the fixed scroll and the wrap portion of the orbiting scroll. In consideration of these points, a high degree of processing precision is required to form the fixed scroll and the orbiting scroll.

However, the fixed scroll and the orbiting scroll are constantly heated and cooled by the gas that is compressed or decompressed in the enclosed spaces, and therefore undergo constant thermal deformation. Moreover, the gas has different temperatures in a central region and an outside region of the scrolls, and therefore thermal strain occurs due to a resulting temperature difference. Scrolls in which thermal strain has occurred are shown in FIG. 3 of Patent Document 2, to be described below.

FIG. 3 of Patent Document 2 is shown in FIG. 5. In FIG. 5, a fixed scroll 100 is constituted by an end plate 102 and a wrap portion 104, while an orbiting scroll 110 is constituted by an end plate 112 and a wrap portion 114. In a scroll type compressor, a temperature and a pressure are low in an outer peripheral portion and increase steadily toward a central portion. Therefore, stress acts on the wrap portion 114 of the orbiting scroll 110 from the central portion toward the outer peripheral portion, causing the wrap portion 114 to deform in the manner of an opening petal. This tendency is also observed in the fixed scroll 100, albeit to a lesser degree. As a result, gaps 120*a* and 120*b* between the wrap portions 104, 114 and the end plates 102, 112 increase from the central portion toward the outer peripheral portion.

However, managing a scroll type compressor to ensure that both the enclosed spaces are tightly sealed and the minute gap is secured between the wrap portions is not easy. One method of securing the minute gap between the wrap portions is to apply a coating to a side face or an end face of the wrap. An optimum gap is formed between the wrap portions by interposing a coating film having a lubricating property and a wear-resistant property between the wrap portions, providing the coating film with a buffer function, and scraping away a surplus part of the coating film during an operation.

Patent Document 1 discloses a configuration in which an elastic coating layer constituted by an elastic material such as rubber or a synthetic resin material is formed on a side face of at least one wrap portion of a scroll, and a lubricating coating layer constituted by a self-lubricating material such as a resin material containing molybdenum disulfide ($MoS_2$), a fluorine-based resin material, or a carbon-based resin material is formed on the elastic coating layer.

Patent Document 2 relates to a scroll type pump, and discloses a configuration and a method for applying a surface coating formed from a coolant-resistant resin containing $MoS_2$ particles to a wrap portion and an end plate of a scroll. In the coating method, the scroll type pump is assembled and operated after applying the surface coating but before the surface coating hardens, whereby surplus surface coating is discharged to the exterior of the scroll such that the surface coating obtains an appropriate coating thickness.

Patent Document 3 discloses a configuration for forming a lubricating coating layer constituted by a similar self-lubricating material to that of Patent Document 1 on a side face of a wrap portion of a scroll.

Patent Document 1: Japanese Patent Application Publication No. H11-280669

Patent Document 2: Japanese Patent Application Publication No. 2003-35284

Patent Document 3: Japanese Patent Application Publication No. 2009-57897

DISCLOSURE OF THE INVENTION

As described above, to ensure that the enclosed spaces formed in the scroll are tightly sealed and to eliminate galling and the like between the wrap portions, the gap between the wrap portions must be controlled precisely. Therefore, in the method for forming a coating film on the side face or the endplate of the wrap portion, the coating layer applied to the side face or the end plate of the wrap portion must be applied at an even coating thickness over the side face or end plate in both the central region and the outside region. However, a technique for enabling this with ease has not yet been proposed, including in Patent Documents 1 to 3.

In the coating method disclosed in Patent Document 2, the coating is handled in an unhardened state. Handling is therefore troublesome, and it is probably difficult to obtain a precise coating thickness.

In consideration of these problems in the prior art, an object of the present invention is to realize a coating formation method with which an even and highly precise coating thickness can be obtained over a wrap portion of a scroll easily and inexpensively.

To solve these problems, a method for forming a coating on a scroll type fluid machine according to the present invention is a coating formation method in which a coating is formed on a side face of a spiral wrap portion of a scroll type fluid machine by spraying a coating solution (a coating formation liquid) onto the side face using a spray nozzle, and includes: a preliminary step of fixing a scroll constituted by the wrap portion and an end plate to a rotating table and rotating the scroll about a spiral center of the wrap portion; a spraying step of moving the spray nozzle in a radial direction of the scroll while spraying the coating solution onto the rotating scroll from the spray nozzle toward the side face of the wrap portion; and a coating thickness adjusting step of keeping a coating thickness of the coating solution constant by adjusting a rotation speed of the scroll in accordance with a radial direction movement of the spray nozzle.

In the method according to the present invention, the coating solution is sprayed toward the side face of the wrap portion from the spray nozzle while rotating the scroll on the rotating table. By adjusting the rotation speed of the scroll and a radial direction movement speed of the spray nozzle relative to the scroll in this condition, the coating can be formed at an even coating thickness. As a result, an even coating can be formed on the side face with a simple configuration.

In the method according to the present invention, a movement speed of the spray nozzle is preferably kept constant, and the rotation speed of the scroll is preferably adjusted in accordance with the movement speed. In this case, the movement speed of the spray nozzle can be kept constant, thereby eliminating the need to adjust the movement speed of the spray nozzle. Hence, only the rotation speed of the scroll need be controlled during an operation, and therefore control can be performed easily. Accordingly, a control device can be simplified.

Note that when the rotation speed of the scroll remains constant, a peripheral speed of the scroll increases steadily from a central region toward an outside region. Hence, when the spray nozzle is moved in the radial direction of the scroll at a constant rotation speed of the scroll, the coating thickness on the side face in the central region becomes greater than the coating thickness on the side face in the outside region. The rotation speed of the scroll must therefore be varied in accordance with the radial direction coating region of the scroll.

In a specific example of the method according to the present invention, the spray nozzle is preferably moved in an outside direction from the spiral center of the wrap, and the rotation speed of the scroll is preferably reduced gradually in accordance with the movement speed of the spray nozzle. In so doing, the coating thickness of the coating can be made even in the central region and the outside region of the scroll.

In another specific example of the method according to the present invention, the spray nozzle is preferably moved from an outer diameter side toward a center of the scroll, and the rotation speed of the scroll is preferably increased gradually in accordance with the movement speed of the spray nozzle. In so doing, the coating thickness of the coating can likewise be made even in the central region and the outside region of the scroll.

Further, in the method according to the present invention, in addition to the respective operations described above, the spray nozzle can be moved rectilinearly without varying an attitude thereof. In so doing, an operation of the spray nozzle can be controlled easily, and therefore a so-called uniaxial system can be used as a driving system for the spray nozzle. As a result, a driving device and a control device for the spray nozzle can be simplified and reduced in cost.

Furthermore, a device for forming a coating on a scroll type fluid machine according to the present invention, which can be used directly to implement the method according to the present invention described above, is a coating formation device that forms a coating on a side face of a spiral wrap portion of a scroll type fluid machine by spraying a coating solution (a coating formation liquid) onto the side face using a spray nozzle, and includes : a rotation device that includes a rotating table to which a scroll constituted by the wrap portion and an end plate is fixed and a driving device for driving the rotating table, and that rotates the scroll about a spiral center of the wrap portion; a coating solution spraying device having a spray nozzle for spraying the coating solution onto the rotating scroll toward the side face of the wrap portion, and a driving device that moves the spray nozzle in a radial direction of the scroll; and a controller that keeps a coating thickness of the coating constant by controlling a rotation speed of the rotating table and a movement speed of the spray nozzle.

In the device according to the present invention, the coating solution is sprayed toward the side face of the wrap portion from the spray nozzle while rotating the scroll on the rotating table. By having the controller adjust the rotation speed of the scroll and the radial direction movement speed of the spray nozzle relative to the scroll in this condition, the coating can be formed at an even coating thickness. As a result, an even coating can be formed on the side face with a simple configuration.

In the device according to the present invention, the coating solution spraying device preferably includes a uniaxial system driving device that moves the spray nozzle along a rectilinear path without varying an attitude of the spray nozzle. Thus, the operation of the spray nozzle can be controlled easily, and therefore a so-called uniaxial system can be used as the driving system for the spray nozzle. As a result, the driving device and the control device for the spray nozzle can be simplified and reduced in cost.

In the device according to the present invention, the spray nozzle preferably includes a slit-shaped discharge port, and a long side of the discharge port preferably has a dimension that corresponds to a height of the side face of the wrap portion. Thus, a long side direction of the spray nozzle can be aligned with a height direction of the side face of the wrap portion, and therefore the coating solution can be applied to the side face from a contact site contacting the end plate to a tip end site in a single application. Hence, the coating can be formed over the entire side face by applying the coating solution only once. As a result, a time required for a coating solution application process can be shortened.

With the method according to the present invention, a coating formation method in which a coating is formed on a side face of a spiral wrap portion of a scroll type fluid machine by spraying a coating solution onto the side face using a spray nozzle includes : a preliminary step of fixing a scroll constituted by the wrap portion and an end plate to a rotating table and rotating the scroll about a spiral center of the wrap portion; a spraying step of moving the spray nozzle in a radial direction of the scroll while spraying the coating solution onto the rotating scroll from the spray nozzle toward the side face of the wrap portion; and a coating thickness adjusting step of keeping a coating thickness of the coating solution constant by adjusting a rotation speed of the scroll in accordance with a radial direction movement of the spray nozzle. Therefore, by adjusting the rotation speed of the scroll and the radial direction movement speed of the spray nozzle relative to the scroll while spraying the coating solution, the coating can be formed at an even coating thickness . As a result, an even coating can be formed on the wrap portion side face of the scroll easily and inexpensively.

Hence, at low cost, an enclosed space of the scroll type fluid machine can be sealed more tightly, and galling, wear, damage, and the like between wrap portions can be suppressed. As a result, an operating efficiency of the scroll type fluid machine can be improved.

Further, with the device according to the present invention, a coating formation device that forms a coating on a side face of a spiral wrap portion of a scroll type fluid machine by spraying a coating solution onto the side face using a spray nozzle includes: a rotation device that includes a rotating table to which a scroll constituted by the wrap portion and an end plate is fixed and a driving device for driving the rotating table, and that rotates the scroll about a spiral center of the wrap portion; a coating solution spraying device having a spray nozzle for spraying the coating solution onto the rotating scroll toward the side face of the wrap portion, and a driving device that moves the spray nozzle in a radial direction of the scroll; and a controller that keeps a coating thickness of the coating constant by controlling a rotation speed of the rotating table and a movement speed of the spray nozzle. Therefore, similar actions and effects to those of the method according to the present invention can be obtained.

BEST MODE FOR CARRYING OUT THE INVENTION

Figure 1:
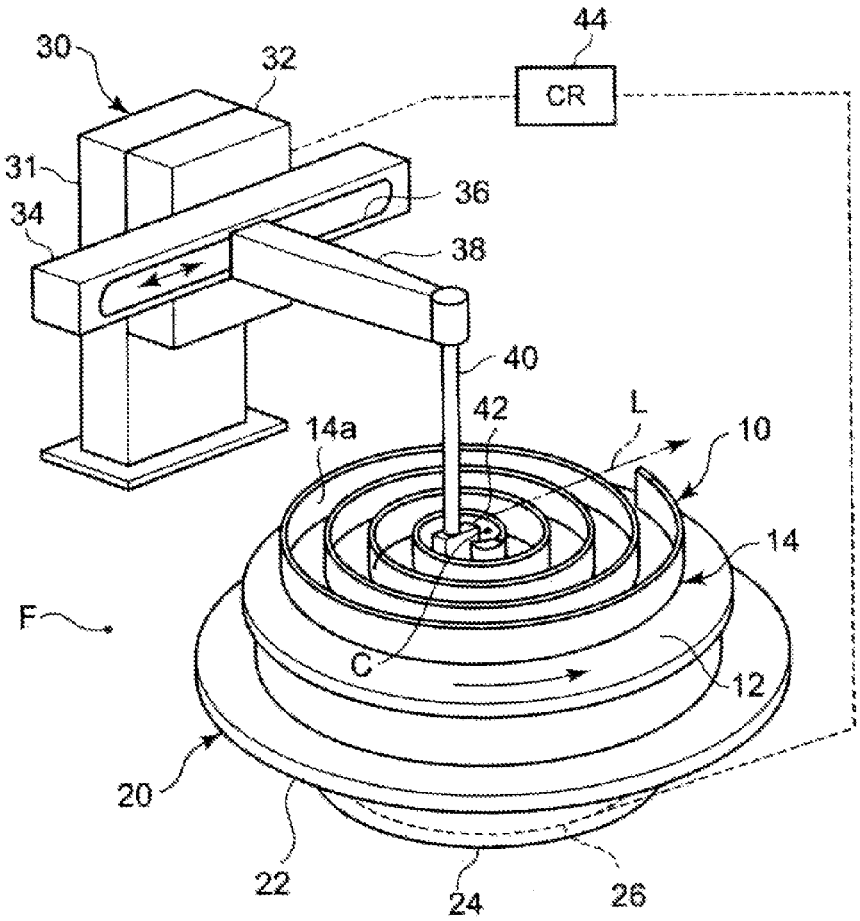
FIG. 1 is a perspective view showing a coating formation process according to a first embodiment of a method and a device according to the present invention.

The present invention will be described in detail using embodiments illustrated in the drawings. Note, however, that unless specific description is provided to the contrary, dimensions, materials, shapes, relative arrangements, and the like of constituent components described in the embodiments are not intended to limit the scope of the present invention.

(First Embodiment)

Figure 2:
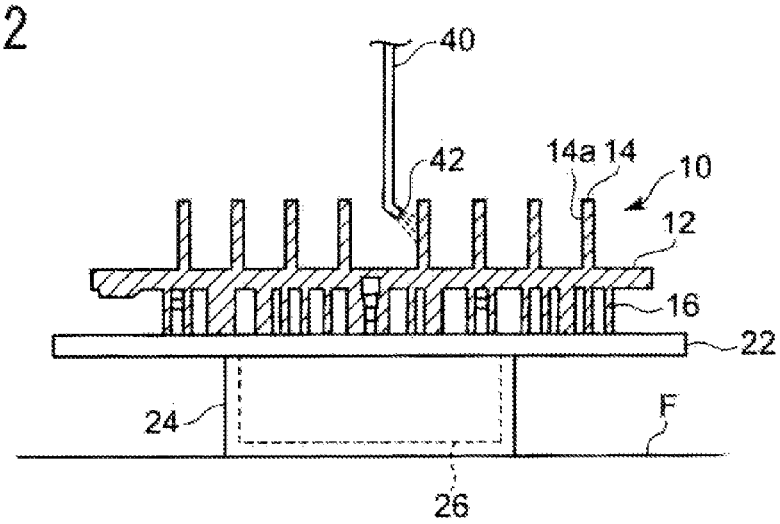
FIG. 2 is an illustrative view showing a cross-section of an orbiting scroll according to the first embodiment.

A first embodiment of a method and a device according to the present invention will be described on the basis of FIGS. 1 and 2. This embodiment is a specific example of a case in which a liquid lubricating coating formed from a thermoplastic resin containing $MoS_2$ particles is applied to an orbiting scroll 10 of a scroll type compressor. The orbiting scroll 10 is constituted by a disc-shaped end plate 12, a spiral wrap portion 14 standing upright on the end plate 12, and as shown in FIG. 2, a large number of radiator fins 16 projecting integrally from a rear surface side of the end plate 12. A rotation device 20 for rotating the orbiting scroll 10 is placed on a floor surface F.

The rotation device 20 is constituted by a disc-shaped rotating table 22 having a larger diameter than the end plate 12, and a casing 24 that is connected to a lower surface of the rotating table 22 and has an inbuilt driving device 26 that rotates the rotating table 22. A coating solution spraying device 30 is fixed to the floor surface F in the vicinity of the rotation device 20. The coating solution spraying device 30 includes a main body portion 31 having an inbuilt coating storage tank, not shown in the drawings, an inbuilt driving device 32 for driving an arm 38, to be described below, to reciprocate in a direction of an arrow, and the like, and a guiding frame 34 having a recessed groove 36 along which the arm 38 slides in the direction of the arrow. The recessed groove 36 is disposed in a horizontal direction and has a rectilinear shape.

The arm 38 is engaged with the recessed groove 36 to be free to slide in the direction of the arrow, and the arm 38 is driven by the driving device 32. A nozzle pipe 40 is attached to a tip end of the arm 38 in a right-angle direction relative to the arm 38. The lubricating coating is supplied to the nozzle pipe 40 from the main body portion 31 side. A spray nozzle 42 is attached to a lower end of the nozzle pipe 40. The spray nozzle 42 is bent diagonally downward from the nozzle pipe 40 such that a circular spray port opposes a wrap portion side face 14*a* of the orbiting scroll 10. Thus, the lubricating coating is sprayed toward the wrap portion side face 14*a* from the spray port.

The spray nozzle 42 moves while maintaining an identical attitude. In other words, there is no need to provide a mechanism for modifying the attitude of the spray nozzle 42. The arm 38 moves in the horizontal direction along a rectilinear movement path L by moving along the recessed groove 36. A controller 44 controls a rotation angle speed of the rotating table 22 by controlling the driving device 26, and controls a movement speed of the spray nozzle 42 in the direction of the rectilinear movement path L by controlling the driving device 32.

With this configuration, when the lubricating coating is to be applied to the wrap portion side face 14*a* of the orbiting scroll 10, the orbiting scroll 10 is placed on the rotating table 22 and positioned such that a spiral center C of the wrap portion 14 is positioned in a rotary center of the rotating table 22. Next, the spray nozzle 42 is disposed in the spiral center C, whereupon the attitude of the spray nozzle 42 is adjusted such that the spray port opposes the wrap portion side face 14*a* in the spiral center position.

In this condition, the rotating table 22 is rotated in a direction of an arrow such that the lubricating coating is discharged from the spray port of the spray nozzle 42 and sprayed onto the wrap portion side face 14*a*. The spray nozzle 42 is then moved along the rectilinear movement path L toward a radial direction outer side of the orbiting scroll 10 while maintaining the attitude thereof at the start of the spraying process.

At this time, the controller 44 controls the movement speed of the spray nozzle 42 to a constant speed, and gradually reduces the rotation angle speed of the rotating table 22 in accordance with the movement of the spray nozzle 42 from the spiral center C in an outside direction of the orbiting scroll 10 while keeping a distance between the nozzle tip end and the wrap portion side face 14*a* constant. If the orbiting scroll 10 is rotated at an identical rotation angle speed throughout the entire lubricating coating application process, a peripheral speed of the orbiting scroll 10 increases steadily in the outside direction from the spiral center C. As a result, a coating thickness of the lubricating coating applied to the wrap portion side face 14*a* decreases steadily from a central region toward an outside region.

In this embodiment, the controller 44 performs control to reduce the rotation angle speed of the rotating table 22 gradually in accordance with the radial direction movement of the spray nozzle 42. As a result, an even coating thickness is obtained on the wrap portion side face 14*a* from the central region to the outside region. When it is not possible to apply the coating solution to the entire wrap portion side face 14*a* in a single application, an identical operation is performed once more to coat the entire wrap portion side face again. The coating solution need only be applied to the single wrap portion side face that contacts the wrap portion 14 of the orbiting scroll 10. In post-processing following the coating formation process, the coating is baked and dried.

According to this embodiment, the lubricating coating can be applied to the wrap portion side face 14*a* at an even coating thickness from the spiral center C to an outside end through the operation described above. Moreover, the movement speed of the spray nozzle 42 remains constant, and therefore this can be realized by simple control in which only the rotation angle speed of the rotating table 22 is controlled. Since complicated control is not required, a simple and inexpensive control device can be used as the control device.

Furthermore, during the application process, the spray nozzle 42 is simply moved rectilinearly along the rectilinear movement path L while maintaining an attitude thereof at the start of the application process. Therefore, a uniaxial system driving mechanism is sufficient as a mechanism for driving the spray nozzle 42. As a result, the configuration of the driving device 32 of the coating solution spraying device 30 can be simplified, enabling a reduction in cost.

Note that in the first embodiment, an operation start position of the spray nozzle 42 is set as the spiral center C of the wrap portion 14, and once the spraying process has begun, the spray nozzle 42 is moved in the outside direction of the orbiting scroll 10. Instead, however, the start position of the spray nozzle 42 may be set as the outside end of the wrap portion 14, and once the spraying process has begun, the spray nozzle 42 may be moved toward the spiral center C side of the orbiting scroll 10. In this case, the rotation angle speed of the rotating table 22 is gradually increased in accordance with the movement speed of the spray nozzle 42.

(Second Embodiment)

Figure 3:
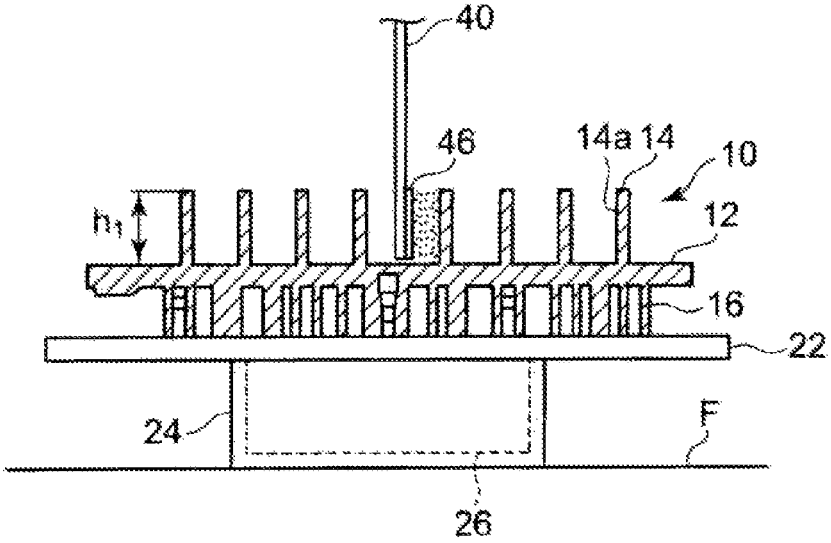
FIG. 3 is a sectional view showing a coating formation process according to a second embodiment of the method and device according to the present invention.
Figure 4:
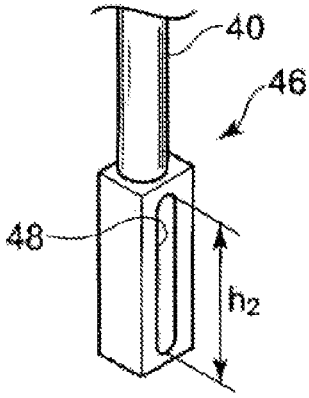
FIG. 4 is an enlarged perspective view of a spray nozzle according to the second embodiment.
Figure 5:
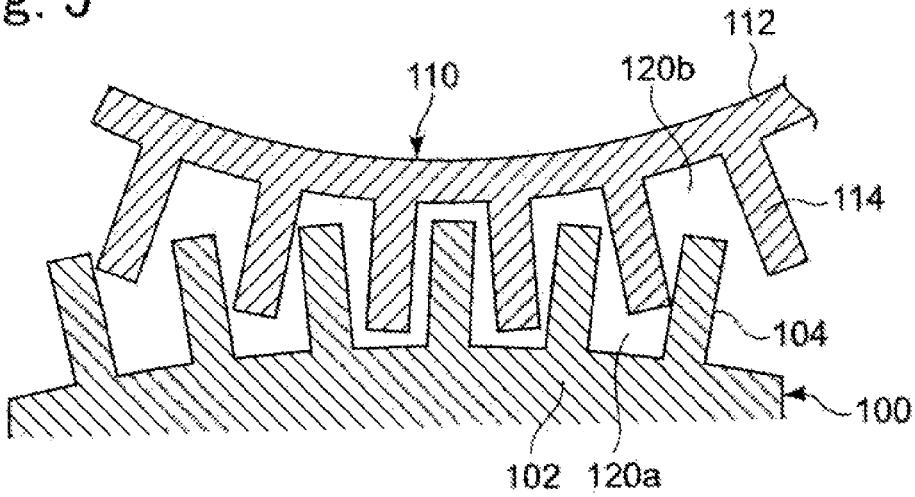
FIG. 5 is a sectional view showing thermal deformation of a scroll type compressor.

Next, a second embodiment of the method and device according to the present invention will be described on the basis of FIGS. 3 and 4. In this embodiment, a discharge port 48 of a spray nozzle 46 takes the shape of an elongated slit extending in a vertical direction. A dimension $h_2$ of a long side of the discharge port 48 is set to be substantially identical to a height dimension $h_1$ of the wrap portion side face 14*a*. Hence, when the lubricating coating is discharged from the discharge port 48, the lubricating coating can be applied to the entire region of the wrap portion side face 14*a* in a height direction, from a connecting portion connected to the end plate 12 to a tip end portion, simultaneously in a single application. All other configurations of this embodiment are identical to the first embodiment, and therefore identical devices and sites are indicated by identical reference symbols.

In the first embodiment and the second embodiment, the coating solution spraying device 30 that moves the arm 38 using a uniaxial system driving mechanism is employed, but instead, the arm 38 may be moved three-dimensionally using a multiaxial system driving mechanism.

Further, in the first embodiment and the second embodiment, the present invention is applied to a case in which a coating is formed on an orbiting scroll of a scroll type compressor, but may also be applied to a case in which a coating is formed on a fixed scroll. The present invention may further be applied to a scroll body of other scroll type fluid machines.

INDUSTRIAL APPLICABILITY

According to the present invention, when a coating is formed on a wrap portion of a scroll type fluid machine, the coating can be formed at an even coating thickness easily using inexpensive equipment and an inexpensive control device.

The invention claimed is:

1. A method of forming a coating on a scroll type fluid machine, in which a coating is formed on a side face of a spiral wrap portion of the scroll type fluid machine by spraying a coating solution onto the side face using a spray nozzle, said method comprising:

fixing a scroll constituted by (i) the wrap portion and (ii) an end plate to a rotating table and rotating the scroll about a spiral center of the wrap portion;

moving the spray nozzle in a radial direction of the scroll while spraying the coating solution from the spray nozzle onto only the side face of the wrap portion of the rotating scroll; and keeping a coating thickness of the coating solution constant by adjusting a rotation speed of the scroll in accordance with a radial direction movement of the spray nozzle.

2. The method according to claim 1, wherein a movement speed of the spray nozzle in the radial direction movement is kept constant, and the rotation speed of the scroll is adjusted in accordance with the movement speed.

3. The method according to claim 1, wherein in the radial direction movement, the spray nozzle is moved outwardly away from the spiral center of the wrap portion, and the rotation speed of the scroll is gradually reduced in accordance with a movement speed of the spray nozzle in the radial direction movement.

4. The method according to claim 1, wherein in the radial direction movement, the spray nozzle is moved inwardly toward the spiral center of the wrap portion, and the rotation speed of the scroll is gradually increased in accordance with a movement speed of the spray nozzle in the radial direction movement.

5. The method according to claim 1, wherein the spray nozzle is moved rectilinearly without varying an attitude thereof.

* * * * *